United States Patent [19]

Bijma et al.

[11] 4,291,251

[45] Sep. 22, 1981

[54] COLOR DISPLAY TUBE

[75] Inventors: Jan Bijma, Eindhoven, Netherlands; Helmut Joeres, Aachen, Fed. Rep. of Germany; Johannes H. M. Johanns, Eindhoven, Netherlands

[73] Assignee: U.S. Philips Corporation, New York, N.Y.

[21] Appl. No.: 69,440

[22] Filed: Aug. 24, 1979

[30] Foreign Application Priority Data

Sep. 8, 1978 [NL] Netherlands ..... 7809160

[51] Int. Cl.[3] ..... H01J 29/50

[52] U.S. Cl. ..... 313/413; 313/412

[58] Field of Search ..... 313/411, 412, 414, 409, 313/413, 460

[56] References Cited

U.S. PATENT DOCUMENTS 2,957,106 10/1960 Moodey ..... 313/414 X

*Primary Examiner*—Palmer C. Demeo

*Assistant Examiner*—Darwin R. Hostetter

*Attorney, Agent, or Firm*—Thomas A. Briody; David R. Treacy; Robert J. Kraus

[57] ABSTRACT

By deflecting the electron beams before the focusing lenses in an electron gun system for a color display tube towards the tube axis by non-symmetrical lens fields so that they converge on the display screen, it has proved possible to obtain symmetrical focusing lens fields by means of mechanically non-symmetrical electrodes the axes of which are parallel, if the beams enclose a given angle with the gun axes. This enables an easy manufacture of the electrodes and an accurate assembly of the guns. In these guns the focusing of the beams is independent of the convergence.

2 Claims, 6 Drawing Figures

COLOR DISPLAY TUBE

BACKGROUND OF THE INVENTION

The invention relates to a colour display tube comprising first electrode means to generate plurality of electron beams, situated along axes parallel to the main axis of said tube; a display screen on which said electron beams converge; second electrode means situated along the path of the electron beams between the first electrode means and the display screen, which second electrode means form a lens field which focuses the electron beams symmetrically; and third electrode means between the first and the second electrode means with which, if desired in cooperation with the first electrode means, an asymmetric lens field is formed to converge the electron beams on the display screen.

Such a colour display tube is disclosed in U.S. Pat. No. 2,957,106. Such display tubes are used inter alia as tubes to display coloured pictures, as oscilloscope tubes, etc. In such tubes it is desired for the electron beams to be converged in one point on the display screen. In U.S. Pat. No. 2,957,106 an asymmetric electron lens is provided in the path of the electron beams which do not coincide with the main axis of the tube between the triode part of the electron gun formed by the cathode, the first and second grids, and the focusing lens, so that the beams are deflected towards each other and converge on the display screen. The focusing lens is formed by a lens field between two electrodes. These electrodes consist of curved electrode plates having apertures therein. The plates are curved so as to be always perpendicular to the electron path. By applying a potential difference between the plates an electron lens is formed which is symmetrical for the electron beams and which has a focusing effect and focuses each electron beam on the display screen. It is very difficult to manufacture such very accurately curved electrode plates and assemble them with respect to each other. Electrodes of such electron guns are assembled by means of assembly pins which have to enclose a very accurate angle with respect to each other. In order to be able to remove the guns from the assembly pins it is necessary for these pins to be connected detachably in a jig as a result of which their mutual angle becomes less accurate as a result of detrition, diurt, bending an breaking of the pins.

This problem is recognized in U.S. Pat. No. 3,906,279 and a solution to this problem is given. This patent teaches a construction for the convergence of three electron beams from three assembled electron guns whch operate independently of each other and the axes of which are parallel and hence parallel assembly pins can be used. This construction is characterized in that of each electron gun which is situated eccentrically with respect to the main axis of the tube, the last electrode situated on the side of the display screen has an axis which is situated eccentrically with respect to the axis of the relevant electron gun in a plane through the main axis of the tube and the axis of the electron gun and at a larger distance from the main axis of the tube than the axis of the electron gun. This last electrode also has a larger diameter than the other electrodes of the electron gun. As a result of the eccentrically placed last electrodes, convergence of the electron beams is obtained in a simple manner and at the same time the electron beams are each focused separately.

U.S. Pat. No. 3,772,554 discloses an integrated system of electron guns operating in an analogous manner. A system of electron guns operating in an analogous manner and in which the focusing lenses of the guns not situated on the tube axis are asymmetrical is known from German Patent Application 2,406,443 laid open to public inspection. All these constructions are less attractive because they exhibit a very important disadvantage. A variation of the strength of the focusing lens in such guns at the same time has a direct influence on the convergence of the electron beams, which is not desired.

SUMMARY OF THE INVENTION

It is therefore the object of the invention to provide a simple construction for focusing and converging electron beams independently of each other by means of electron guns the axes of which are parallel so that a simple, rapid and accurate manufacture and assembly are possible.

According to the invention, a colour display tube of the kind mentioned in the opening paragraph is characterized in that the axes of the electrodes of all electrode means are parallel to the axes axes and that of the second electrode means which are eccentric with respect to the main axis of the tube, the last electrodes (76, 96, 106) situated on the side of the display screen have axes (54) which are eccentric with respect to the axes (55) of the associated preceding electrodes (75,95, 105) and to the axes (62) of the associated first electrode means, the axes (55) of those preceding electrodes (75, 95, 105) having a smaller distance to the main axis of the tube than the axes (54) of the associated last electrodes (76, 96, 106) situated on the side of the display screen, the last-electrode axes (54) in turn having a smaller distance to the main axis of the tube than the axes (62) of the associated first electrode means (71, 72, 73, 91, 92, 93).

The invention is based on the recognition that, when an electron beam is incident in such a mechanically non-symmetric electrode system at a given angle with the gun axis, a symmetric focusing of the electron beam can nevertheless be obtained so that a variation of the strength of the focusing lens has no influence on the convergence. This given angle which depends on the gun dimensions can be determined experimentally on an optical bench.

A preferred embodiment of such a colour display tube embodying the invention is characterized in that all these axes are situated in one plane and the axes of one of the first electrode means and the associated second electrode means coincide with the main axis of the tube and the axis of two other first and second electrode means are situated symmetrically with respect to the main axis of the tube.

BRIEF DESCRIPTION OF THE DRAWINGS

The invention will now be described in greater detail with reference to a drawing, in which.

DESCRIPTION OF THE PREFERRED EMBODIMENTS

Figure 1:
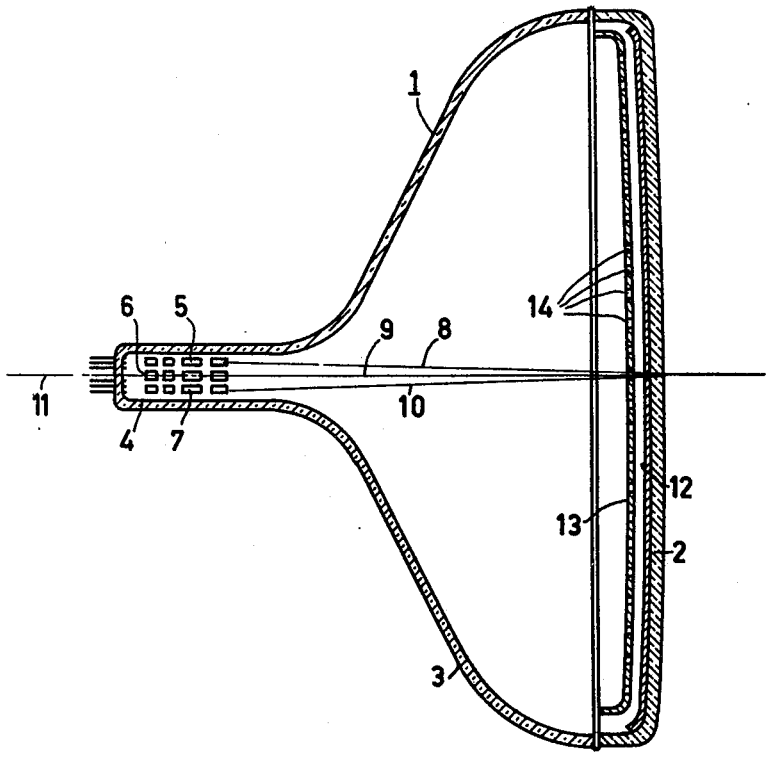
FIG. 1 is a cross-sectional view of a colour display tube embodying the invention.

FIG. 1 is a cross-sectional view of a colour display tube embodying the invention. In a neck 4 of a glass envelope 1 further composed of a display window 2 and a conical part 3, three electron guns 5, 6 and 7 are provided which generate the electron beams 8, 9 and 10. The axes of these electron guns are situated in one plane, the plane of the drawing. The axis of the central electron gun 6 coincides with the main axis 11 of the envelope. The three electron guns consist of a number of cylindrical electrodes placed along an axis. As is known, it is possible to construct one or more of the juxtaposed electrodes of the guns as one assembly. A large number of triplets of phosphor lines are provided on the inside of the display window. Each triplet comprises a line consisting of a green luminescing phosphor, a line consisting of a blue luminescing phosphor and a line consisting of a red luminescing phosphor. All triplets together constitute the display screen 12. The phosphor lines extend perpendicularly to the plane of the drawing. A shadow mask 13 having a large number of elongate apertures 14 parallel to the phosphor lines, through which apertures the electron beams 8, 9 and 10 pass, is placed before the display screen. Since the electron beams enclose a small angle with each other and converge on the display screen, each beam is incident only on phosphor lines of one colour via the elongate apertures. As is known, it is alternatively possible to provide the electron guns in a triangular arrangement in the tube, each gun being situated at the corner of an equilateral triangle. In that case the shadow mask has circular apertures and the display screen is composed of triplets of phosphor dots.

Figure 2:
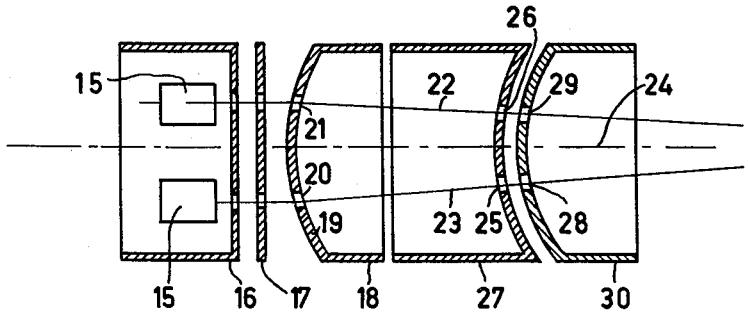
FIG.2 PRIOR ART
FIGS. 2 and 3 are cross-sectional views of prior-art electron guns.
Figure 3:
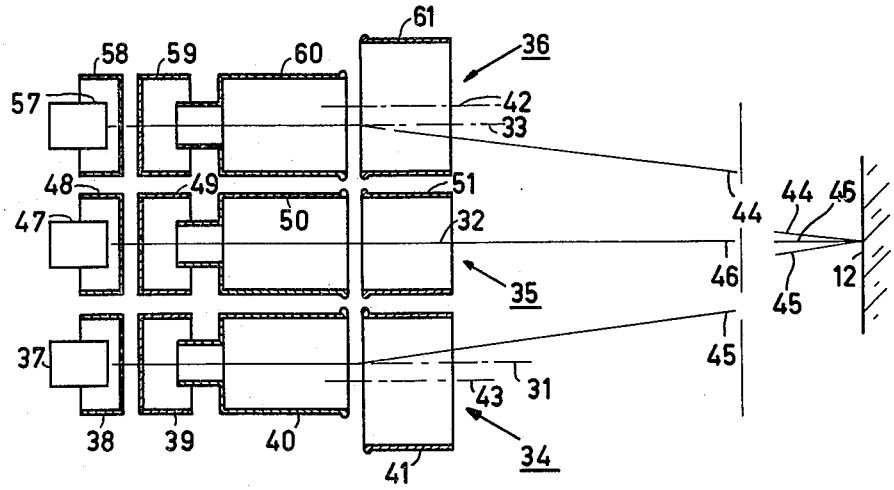
PRIOR ART FIG.3

FIG. 2 is a cross-sectional view of a prior-art electron gun (U.S. Pat. No. 3,957,106). The means to generate the electron beams each consist of a cathode 15, a grid electrode 16 and an accelerating electrode 17. The convex portion 19 of electrode 18 is provided with apertures 20 and 21. As a result of the convex portion 19 of electrode 18 a non-symmetrical electrostatic field is formed between the electrodes 17 and 18 so that the electrode beams 22 and 23 are bent towards the axis 24 in such manner that these beams converge on the display screen 12. The apertures 25 and 26 in electrode 27 and the apertures 28 and 29 in electrode 30 are provided so that they are placed in the path of the electron beams. The curvature of the convex portions of the electrodes 27 and 30 in which said apertures are provided is such that their surfaces always extend perpendicularly to the paths of the electron beams. As a result of this and by applying a sufficiently large potential difference between the electrodes 27 and 30 a symmetrical lens field is obtained between the electrodes which has a symmetric focusing effect on the electron beams. As a rsult of this, variations in strength of the lens field have no influence on the convergence. The manufacture of electrodes having such accurately curved surfaces is very difficult and the assembly is inaccurate because assembly pins have to be used which enclose an angle with each other. FIG. 3 shows a system of electron guns (U.S. Pat. No. 3,906,279) in which all the axes 31, 32 and 33 of the electron guns 34, 35 and 36 extend parallel to each other and are situated in one plane. The gun 34 has a cathode 37 and a grid 38 and an anode 39 and grids 40 and 41. The corresponding electrodes of gun 35 are referenced 47 to 51. The corresponding electrodes of gun 36 are referenced 57 to 61.

As is shown in this Figure, the grids 41 and 61 have a larger diameter than the associated grids 40 and 60 and the axes 42 and 43 are situated farther away from the axes 32 than the gun axes 31 and 33. The lens fields between the electrodes 40 and 41 and between the electrodes 60 and 61 are hence not symmetrical and deflect the beams 44 and 45 towards the central beam 46. These lens fields and the lens field between the grids 50 and 51 also serve to focus the electron beams. A small variation in the voltage difference between the electrodes 40 and 41 and between the electrodes 60 and 61 hence has an influence on the convergence and also on the focusing of the electron beams. It will be obvious that this is undesired since it should be possible to provide variations in the focusing and convergence preferably independently of each other.

Figure 4:
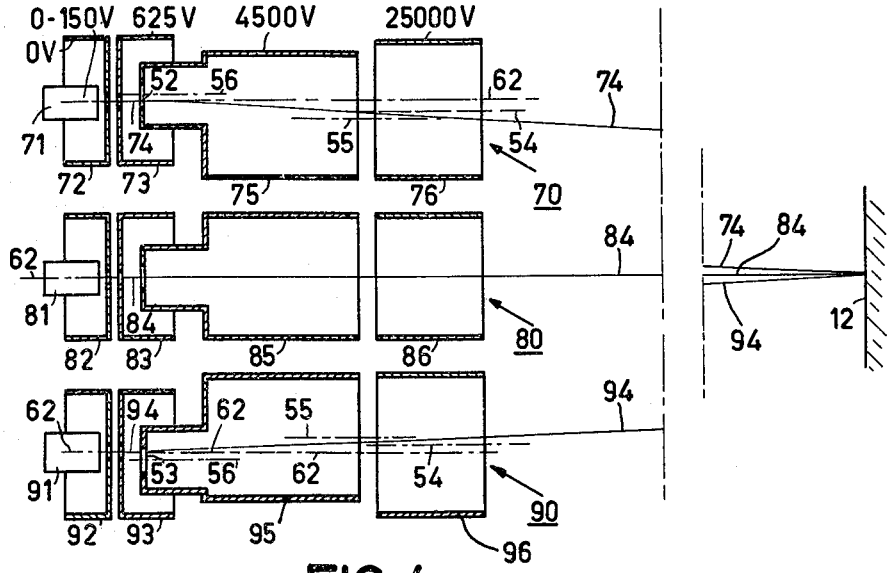
FIGS. 4 to 6 are cross-sectional views of a number of embodiments of electron guns used in colour display tubes embodying the invention.

FIG. 4 shows a first embodiment of an electron gun system in which no curved parts are necessary, all the axes of the electrodes extend parallel to each other and nevertheless a convergence is possible which is independent of the focusing voltage (the voltage difference between the last two electrodes in an electron path). It consists of three guns 70, 80 and 90 having the cathodes 71, 81 and 91 in grids 72, 82 and 92 and opposite to the electrodes 73, 83 and 93. By means of these electrode means, three electron beams 74, 84 and 94 are generated which initially extend parallel to each other. By providing the grids 75 and 95 with apertures 52 and 53 which are situated so as to be not symmetrical with respect to the beams 74 and 94, the electron beams 74 and 94 are deflected towards the central electron beam 84 in a manner analogous to that of U.S. Pat. No. 2,957,106. The focusing is done by the lens fields between the electrodes 75 and 76, 85 and 86 and 95 and 96. In contrast with the construction disclosed in U.S. Pat. No. 3,906,279, any variation of the focusing lens fields between the electrodes 75 and 76 and between the electrodes 95 and 96 of the outermost electron guns has no influence at all on the convergence because the electron beams 74 and 94 are incident through said lens fields at a given angle with the gun axes. As a result of this, a focusing lens acting symmetrically on the beam is obtained by means of a few electrodes which are situated non-symmetrically.

An example of the electric voltages (in Volts) applied to the various electrodes is shown in FIG. 4 for gun 70. A number of dimensions of electrodes and their mutual distances are recorded in the table below:

| electrode no. | length (mm) | diameter (mm) | mutual distance (mm) | diameter opening (mm) |
|---|---|---|---|---|
| 76 | 8 | 7.6 | | |
| 76-75 | | | 1 | |
| 75 | 16.2 | 7.4 | | 1.5 |
| 75-73 | | | 1.4 | |
| 73 | 5.4 | | | 0.75 |
| 73-72 | | | 0.35 | |
| 72 | | | | 0.75 |
| 72-71 | | | 0.12 | |
| 71 | | | | |

Figure 5:
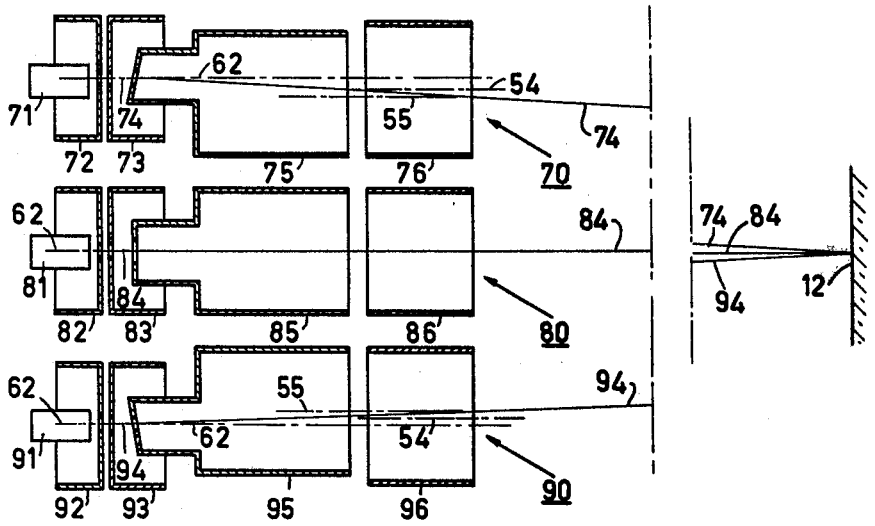

The distance from axis 54 of electrode 76 to the gun axis 62 is 0.3 mm. The distance from axis 55 to axis 62 is 0.4 mm and the distance from axis 56 to axis 62 is 0.2 mm. For other gun dimensions, other mutual axial distances are necessary. These can be determined experimentally on an optical bench or can be calculated. The thickness of the material (Cr-Ni-steel) from which the varous electrodes are manufactured is in this embodiment 0.13 to 0.2 mm. The distance between two gun axes is 10 mm. FIG. 5 is a cross-sectional view of a second embodiment of an electron gun system according to the invention.

For clarity, the same reference numerals are used as in FIG. 4. The convergence of the electron beams 74, 84 and 94 is obtained in this embodiment by causing the ends of the electrodes 75 and 95 situated oppositely to the electrodes 73 and 93 to enclose an angle of approximately 87° with the gun axis. This convergence method is also disclosed already in U.S. Pat. No. 2,957,106. The various dimensions correspond approximately to the dimensions indicated with reference to FIG. 4. The electron beams 74, 84 and 94 also converge on the display screen 12. The convergence is independent of the strength of the focusing lens. The convergence of the electron beams can alternatively be obtained by shifting and/or tilting the electrodes 73 and 93 as a result of which the non-symmetrical deflecting lenses are obtained in cooperation with the electrodes 75 and 95. This will not be further described.

Figure 6:
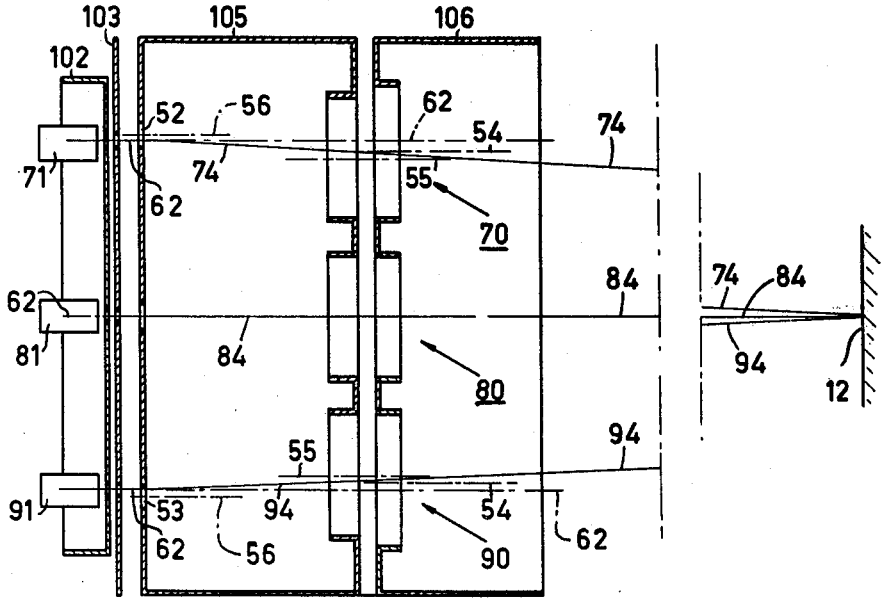

FIG. 6 is a cross-sectional view of a third embodiment of an electron gun system embodying the invention. The electron gun system comprises a number of electrodes 102, 103, 105 and 106 which are constructed so as to be common for the three electron beams. The Figure is drawn approximately to the same scale as FIGS. 4 and 5. For clarity, the same reference numerals are used as much as possible as in FIGS. 4 and 5. It will be obvious that one of the electrodes may be divided into two sub-electrodes or that an extra electrode may be added without this influencing the essence of the invention.

What is claimed is:

1. An electric discharge tube comprising an envelope having a main axis, a display screen and an electron gun system for producing a plurality of electron beams and converging the beams on the display screen, the electron gun system comprising first electrode means for generating the electron beams, the first electrode means being situated along axes parallel to the main axis of said tube; second electrode means situated along the path of the electron beams between the first electrode means and the display screen, said second electrode means comprising respective last electrodes situated on the side toward the dislay screen and an associated preceding electrode, with electrodes in use constitute a lens field which focuses the electron beams symmetrically; and third electrode means between the first and the second electrode means for forming an asymmetric lens field to coverge the electron beams on the display screen, characterized in that the axes of the electrodes of all electrode means are parallel to said axes of the first electrode means; and the last electrodes (76, 96, 106), situated on the side toward the display screen, of those second electrode means which are situated eccentrically with respect to the main axis of the tube, have axes (54) which are situated eccentrically with respect to the axes (55) of the associated preceding electrodes (75, 95, 105) and to the axes (62) of the associated first electrode means, the axes (55) of said preceding electrodes (75, 95, 105) having a smaller distance to the main axis of the tube than the axes (54) of the associated last electrodes (76, 96, 106) situated on the side toward the display screen, said axes (54) of said last electrodes in turn having a smaller distance to the main axis of the tube than the axes (62) of the associated first electrode means (71, 72, 73, 91, 92, 93).

2. An electric discharge tube as claimed in claim 1, characterized in that all said axes are situated in one plane, the axes of one of the first electrode means and the associated second electrode means coincide with the main axis of the tube, and the axes of two other first and second electrode means are situated symmetrically with respect to the main axis of the tube.

* * * * *